US008262304B2

(12) United States Patent
Llach et al.

(10) Patent No.: US 8,262,304 B2
(45) Date of Patent: Sep. 11, 2012

(54) HIGHLIGHTER AND PEN COMBINATION

(76) Inventors: Sergio Llach, Coral Gables, FL (US); Russell Robertson, Brooklyn, NY (US); Jeanne Pfordresher, Brooklyn, NY (US)

( * ) Notice: Subject to any disclaimer, the term of this patent is extended or adjusted under 35 U.S.C. 154(b) by 357 days.

(21) Appl. No.: 12/563,557

(22) Filed: Sep. 21, 2009

(65) Prior Publication Data

US 2010/0183354 A1 Jul. 22, 2010

Related U.S. Application Data

(60) Provisional application No. 61/145,151, filed on Jan. 16, 2009.

(51) Int. Cl.
*B43K 24/02* (2006.01)

(52) U.S. Cl. ..... 401/109; 401/29

(58) Field of Classification Search ..... 401/29–33, 401/109–112, 116, 117
See application file for complete search history.

(56) References Cited

U.S. PATENT DOCUMENTS 3,985,455 A * 10/1976 Wahlberg ..... 401/30
4,047,017 A 9/1977 Herring
4,606,665 A 8/1986 Schleif
5,026,189 A * 6/1991 Keil ..... 401/29
5,142,161 A 8/1992 Brackmann
5,542,588 A 8/1996 Sison
6,217,241 B1 4/2001 Kobayashi
6,290,413 B1 * 9/2001 Wang ..... 401/30
6,471,432 B1 10/2002 Kremer
6,802,665 B2 10/2004 Brown
7,014,380 B2 3/2006 Ono
7,290,955 B2 * 11/2007 Patel et al. ..... 401/264
7,390,137 B1 * 6/2008 Rentz ..... 401/112
2007/0081849 A1 4/2007 Yu

OTHER PUBLICATIONS

Papermate 2in1—http://www.papermate.com/sanford/consumer/papermate/jhtml/product/product_detail.jhtml?attributeId=7700001&_DARGS=/sanford/consumer/papermate/nav/leftnavbrand.jhtml—accessed on Sep. 22, 2009.
Bic Duo—http://www.biceveryday.com/products/pens/duo.aspx—accessed on Sep. 22, 2009.
Combi—http://www.uni-ball.net/promotional-pens-uni-ball-combi.php—accessed on Sep. 22, 2009.

* cited by examiner

*Primary Examiner* — David Walczak
(74) *Attorney, Agent, or Firm* — Gottieb, Rackman & Reisman, P.C.

(57) ABSTRACT

A combination pen and highlighter includes a body, at least one anchor which connects the body to an extendable highlighter and a button for manipulating the highlighter. The combination uses two separate springs to lock the highlighter in either a closed position or a highlighter extended position.

6 Claims, 7 Drawing Sheets

HIGHLIGHTER AND PEN COMBINATION

RELATED APPLICATIONS

The present application claims priority under 35 USC §119 to provisional patent application Ser. No. 61/145,151 filed Jan. 16, 2009, and is herein incorporated by reference.

FIELD OF THE INVENTION

The present invention relates to a more efficient writing instrument which can be adapted to be used as either an ink pen or a highlighter.

BACKGROUND

Both ink pens and highlighters are well known. Pens and highlighters are extensively used in almost every field, from students to contractors and everyone in between. In many circumstances, such as when an individual is using the highlighter and simultaneously making notes in the margin, having both a pen and a highlighter available is very useful. One method of solving this problem is to switch between two separate writing instruments.

A second method of solving this problem is to create a writing instrument which incorporates both a pen and a highlighter. A combination pen and highlighter is advantageous because the user always has both pen and highlighter without having to carry multiple instruments and the user can switch between pen and highlighter without having to place one down and retrieve the other.

Two prior art highlighter and pen combinations are the Paper Mate® 2-in-1™ and the Uni-ball® Combi. These two devices both contain a ball point pen in combination with a highlighter, but the highlighter and pen are located on opposite sides of the device. While this design ensures a user has both a highlighter and a pen nearby, the design does not provide for an easy and comfortable transition between pen use and highlighter use.

The Bic® Duo is another pen and highlighter combination device. Unlike the Paper Mate® 2-in-1™ or the Uni-ball® Combi, the Duo provides both the highlighter and the pen on a single side of the device. The Duo includes a ball point pen in the middle of the construction and a donut cross-sectioned highlighter. The donut cross-sectioned highlighter surrounds the pen.

The Duo has two distinct limitations. First, the Duo relies on a twisting motion to extend and retract the highlighter. This twisting motion requires the use of a second hand. Thus the user's efficiency is limited. Second, the shape and position of the highlighter requires that the Duo's highlighter reservoir surrounds the pen reservoir. Therefore, the volume of the highlighter reservoir becomes limited. Highlighter fluid can be used very quickly during normal use of a highlighter. In addition, highlighter fluid is prone to drying out, even when a top is used. It has been found that the highlighter of the Duo requires additional motion to transition between highlighter and pen, and the Duo highlighter dries out much quicker than standard highlighters.

The present invention is advantageous over these prior art pens because it provides an ergonomic mechanism for transitioning between pen and highlighter and it provides a large highlighter fluid reservoir (highlighter wick 300).

SUMMARY OF THE INVENTION

A highlighter and pen combination provides one writing instrument with the functionality of both an ink pen and a highlighter. Both the ink pen and the highlighter are included in the body of the instrument. The ink pen is fixed with respect to the body, but the highlighter can be extended and retracted through the use of a button and spring assembly.

The button and spring assembly includes two anchors which are attached by a highlighter chamber and a first spring. A second spring applies pressure to the front anchor, biasing the highlighter to a closed position. The second spring is located between the front anchor and the body. A user can push down and forward on the button to move the button and spring assembly forward compressing the second spring. This action extends the highlighter into an extended position.

To lock the highlighter in the extended position, the user allows the first spring to raise the button bringing a lock located on the rear anchor above the body. Then the button is gently released and the lock holds the button and spring assembly in place against the force of the second spring.

The highlighter and pen combination is operated by toggling between the closed position and the highlighter extended position as described above.

DETAILED DESCRIPTION OF THE INVENTION

Figure 4:
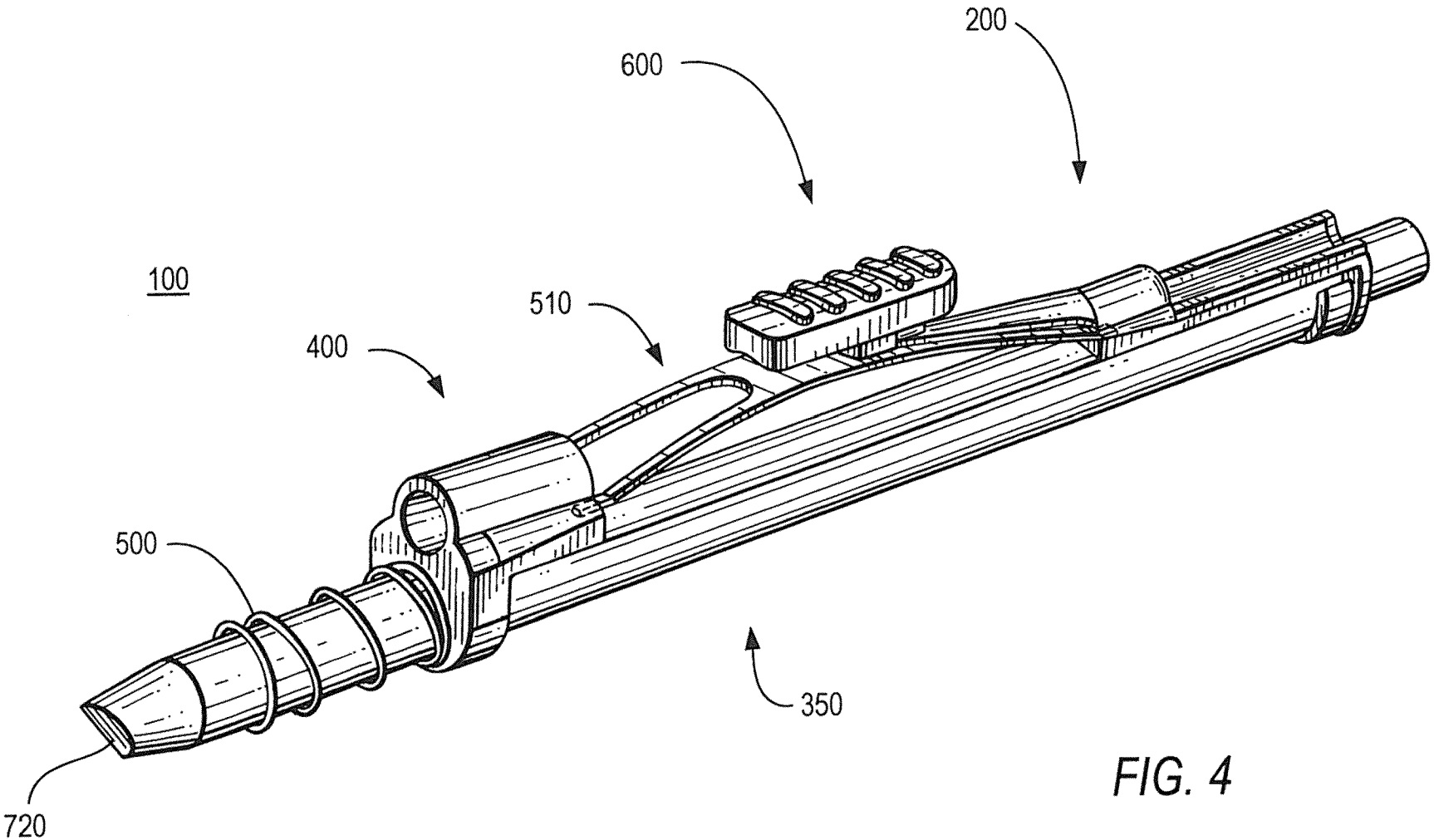
FIG. 4 is a perspective view of the core of the highlighter-pen combination of the present invention.

As illustrated in FIG. 4, core 100 of the highlighter pen includes front anchor 400, rear anchor 200, highlighter tip 720, highlighter chamber 350, steel spring 510, coil spring 500 and button 600.

Figure 5:
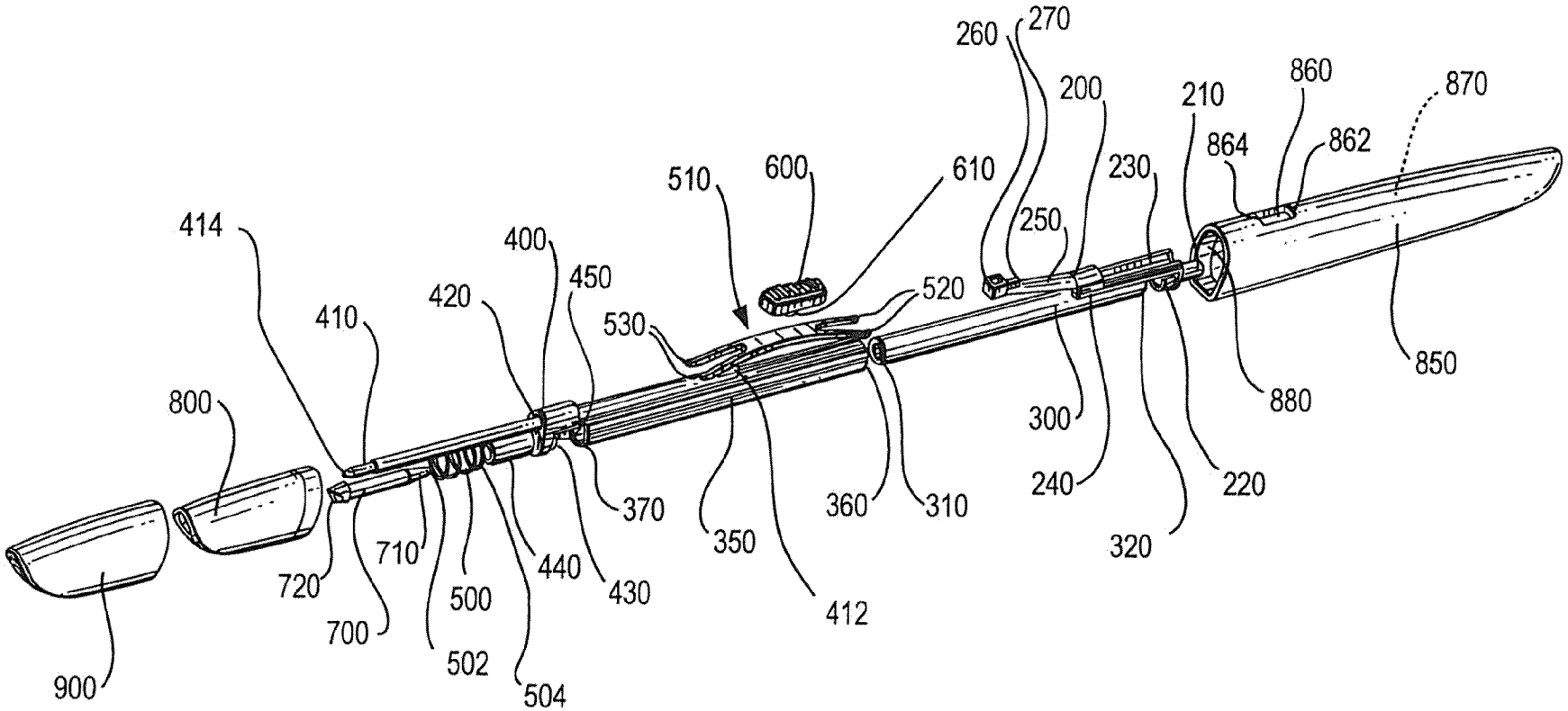
FIG. 5 is an exploded view of the highlighter-pen combination of the present invention.

The highlighter pen is preferably constructed as follows. Referring to FIG. 5, back end 504 of coil spring 500 is secured to front anchor spring connector 440. Ink nib 700 is secured to front anchor spring connector 440. Highlighter chamber 350 is filled with highlighter wick 300. Highlighter chamber 350 is connected to front anchor-chamber connector 430 of front anchor 400.

Steel spring rear legs 520 are inserted into rear connection channels 240. Steel spring front legs 530 are inserted into front connection channels 450 and wick support 220 is fixed to chamber rear end 360. At this point in the assembly, it is preferable to glue or otherwise bond the assembled parts, other than steel spring 510, together in a more permanent manner. This combination of elements comprises core 100 of the highlighter pen.

After the bonding, ball point pen 410 is passed through front anchor pen support 420 and back anchor pen support 230. To complete the assembly of the highlight pen, rear anchor 200 is inserted into opening 880 of body (or distal end) 850. Rear end 412 of ball point pen 410 fits into rear molded ribs 870 within body 850. Rear molded ribs 870 secure ball point pen 410 in a fixed position with respect to body 850. Front piece 800 is placed over highlighter tip 720 and ball point pen tip 414. Ball point pen tip 414 fits securely to front piece 800 by internal ribs (not shown) at tip of 800. Front piece 800 connects with body 850 and encloses the previously discussed assembly.

Figure 3:
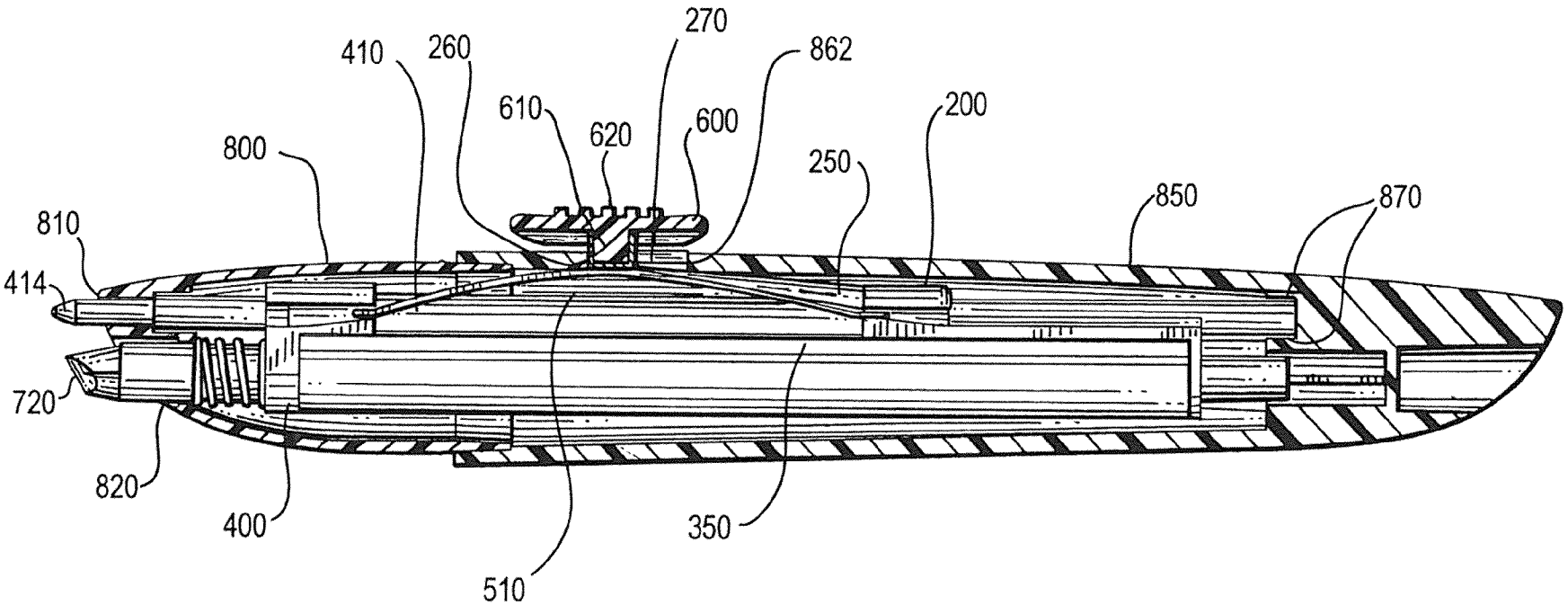
FIG. 3 is a side cross-sectional view of the highlighter-pen combination of the present invention, in the highlighter extended position.

As illustrated in FIG. 3, front piece (or proximal end) 800 includes pen opening 810 for pen tip 414 to extend through, and highlighter opening 820 for highlighter tip 720 to extend through. Front piece 800 and body 850 can be secured together by glue. Lastly, button 600 is secured to rear anchor 200. Specifically, button post 610 attaches to button seat 260. Preferably, button post 610 is glued in place.

Figure 1:
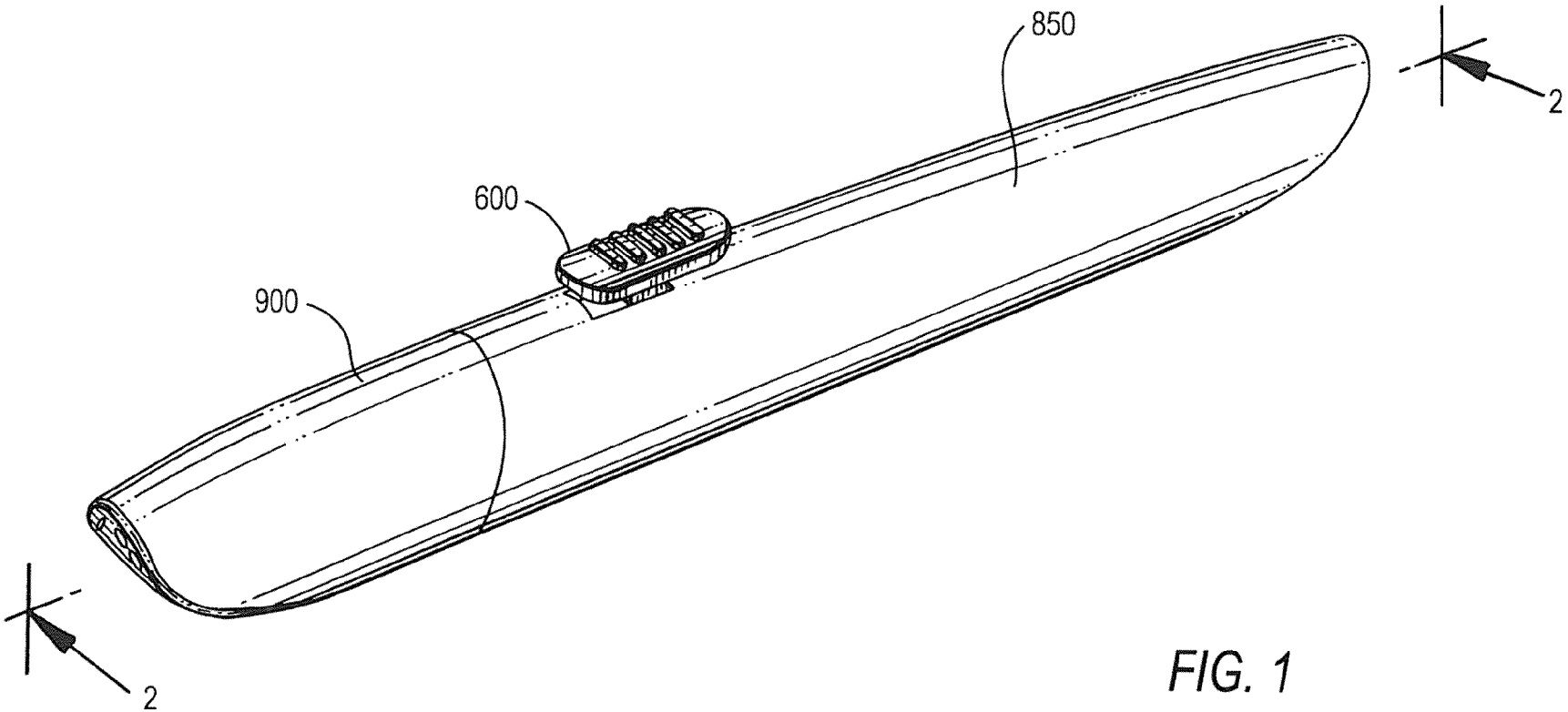
FIG. 1 is a perspective view of the highlighter-pen combination of the present invention, including a cap.
Figure 2:
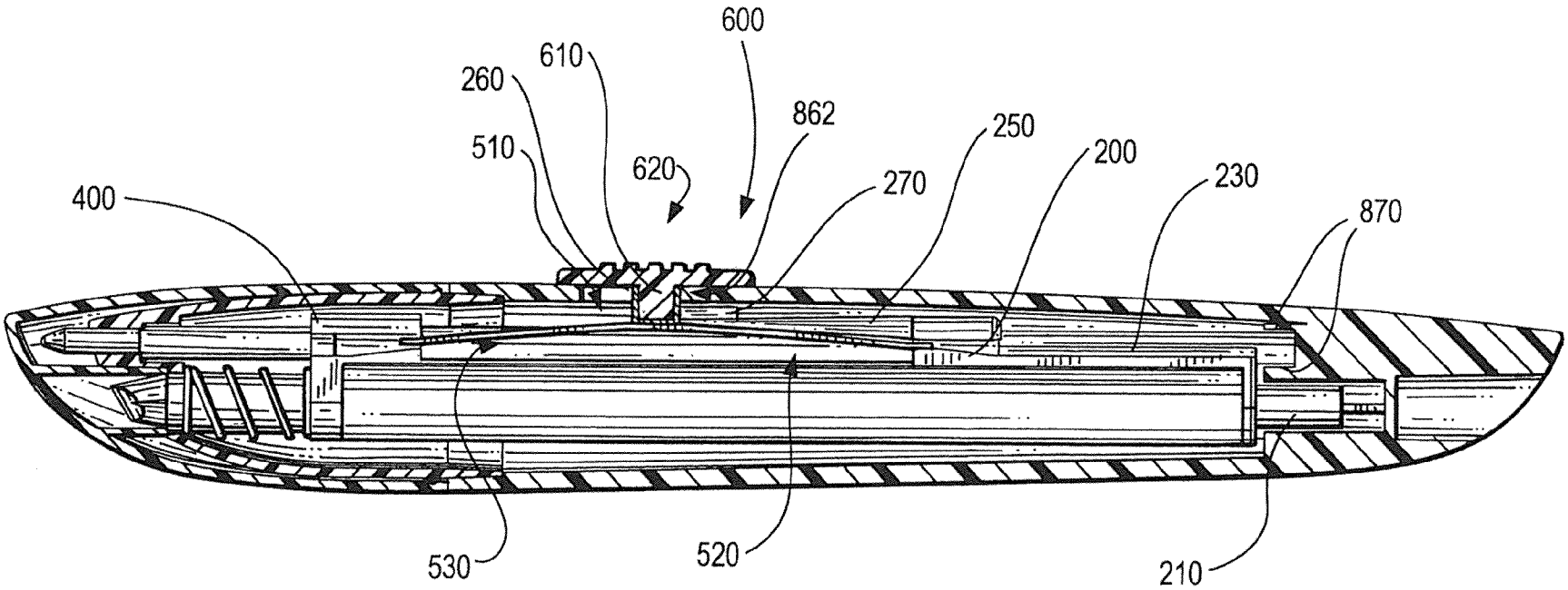
FIG. 2 is a side cross-sectional view of the highlighter-pen combination of the present invention, in the closed position and including a cap.

As illustrated in FIGS. 2 and 3, the highlighter pen has two positions, the closed position of FIG. 2 and the highlighter extended position of FIG. 3. In both positions, ball point pen 410 is secured to body 850 and front piece 800. In the closed position, highlighter tip 720 is stored inside front piece 800 and coil spring 500 is expanded and not under significant tension. Also characteristic of the close position is that button 600 is positioned in the rear of button opening 860. In this position, button seat 260 is touching or very close to touching body 850 at edge 862. To switch from closed position to highlighter extended position, a user presses down on steel spring 510 causing both steel spring front legs 530 and steel spring rear legs 520 to extend deeper into front spring connection channels 450 and rear spring connection channels 240, respectively. Since button post 610 is connected to rear anchor 200 at button seat 260, once both set of legs, 520 and 530, are extended, forward pressure on button 600 will move core 100 forward.

Both anchors are connected to highlighter chamber 350. Front anchor 400 is connected to ink nib 700. Ink nib 700 protrudes through front anchor 400 and connects with highlighter wick 300. As front anchor 400 moves forward, it compresses coil spring 500, which is fixed between front anchor 400 and front piece 800. Thus, coil spring 500 creates a rearward force against core 100.

Looking at FIG. 3, in order to fix core 100 in the highlighter extended position, the user should allow steel spring 510 to force button 600 upward by pushing forward on button grip 620. This will cause back anchor arm 250, button seat 260 and lock 270 also extend upward. Back anchor 200 should be constructed of a flexible yet strong material to allow back anchor arm 250 to bend. Once lock 270 is raised to the level of edge 862, the user can gently release button 600 and the force exerted on core 100 by coil spring 500 will cause lock 270 to fit against edge 862. This fit will secure core 100 in the highlighter extended position. The length of lock 270 should be approximately the same as the length traveled by ink nib 700

In order to switch back to closed position, a user presses down on button 600 to break the fit between lock 270 and edge 862. Then the user presses downward on button 600 to extend steel spring front legs 530 and steel spring rear legs 520. This will lower lock 270 below edge 862. With lock 270 disengaged, the force from coil spring 500 will push core 100 rearward, driving ink nib 700 back to the closed position.

Figure 6A:
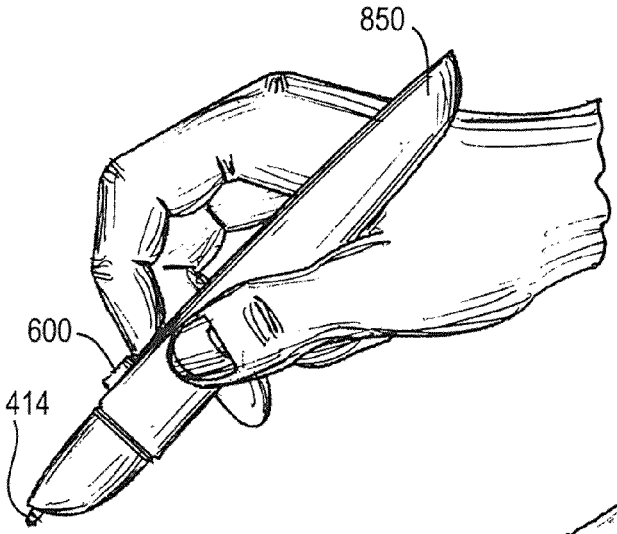
FIG. 6A is a side view of the highlighter-pen combination of the present invention, being used as a pen.
Figure 6B:
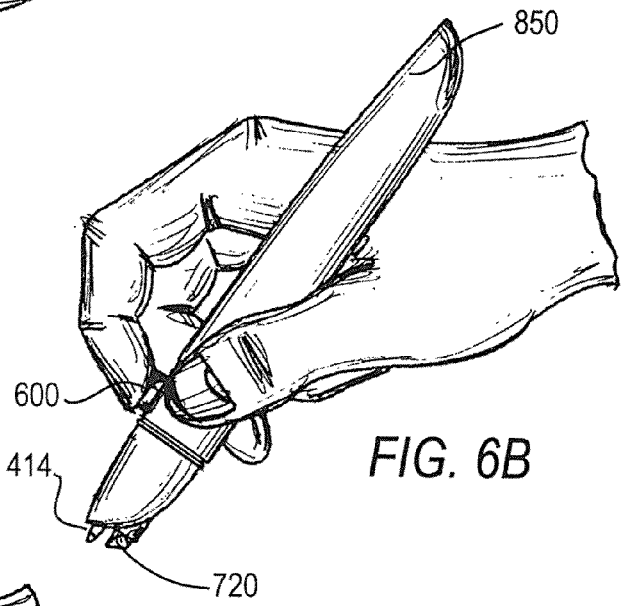
FIG. 6B is a side view of the highlighter-pen combination of the present invention, with the highlighter tip being extended.
Figure 6C:
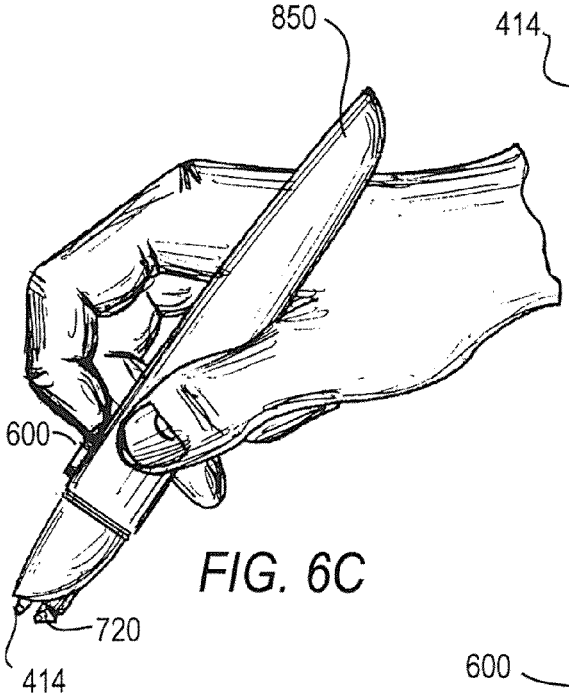
FIG. 6C is a side view of the highlighter-pen combination of the present invention, being used as a highlighter.
Figure 6D:
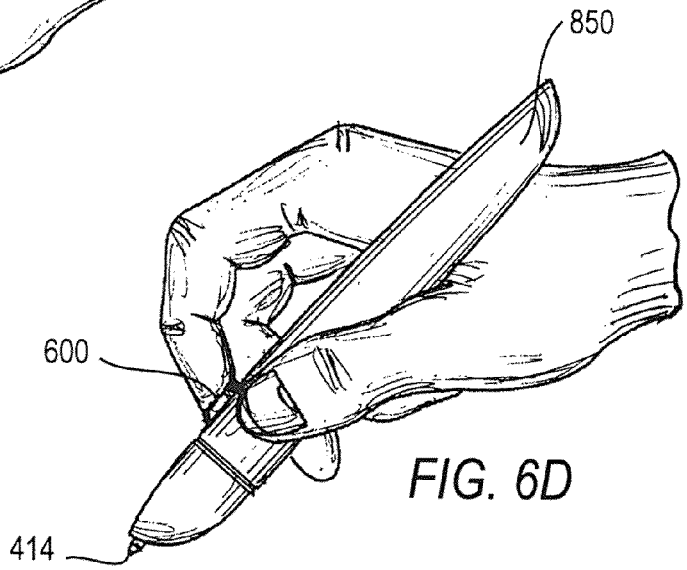
FIG. 6D is a side view of the highlighter-pen combination of the present invention, with the highlighter tip being retracted.

Preferably, the highlighter pen is held in the user's hand and is operated as a conventional highlighter or pen. To switch from pen operation to highlighter operation, button 600 is toggled as discussed above and illustrated in FIGS. 6A-6D. FIG. 6A shows the pen with highlighter tip 720 retracted and the user writing with pen tip 414. In FIG. 6B, the user has applied a force to button 600 to extend highlighter tip 720. In FIG. 6C, the user is writing with highlighter tip 720, while pen tip 414 remains above the writing surface. In FIG. 6D, the user is retracting highlighter tip 720.

Figure 7A:
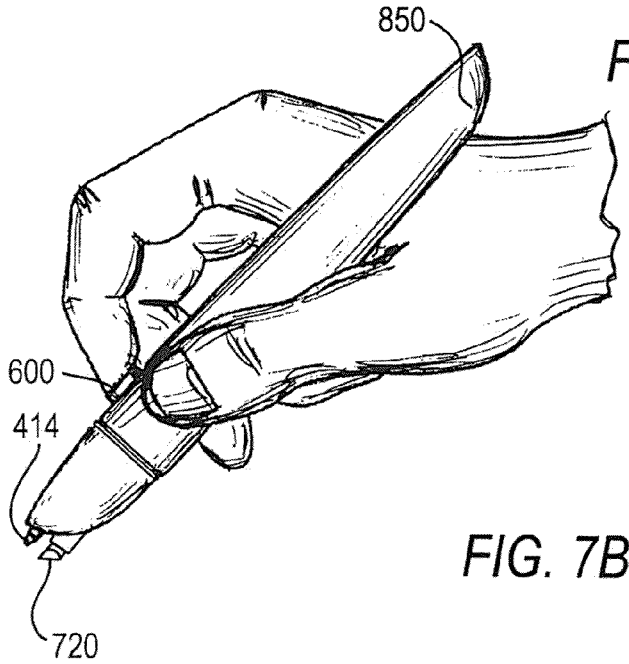
FIG. 7A is a side view of the highlighter-pen combination of the present invention, being used as a highlighter.
Figure 7B:
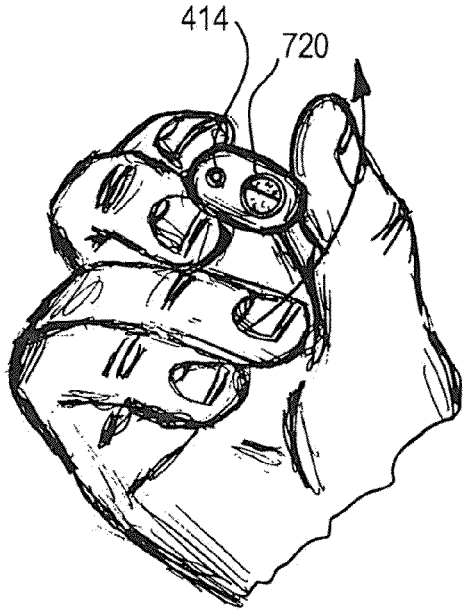
FIG. 7B is a front view of the highlighter-pen combination of the present invention, being rotated to bring the pen tip to the bottom position.
Figure 7C:
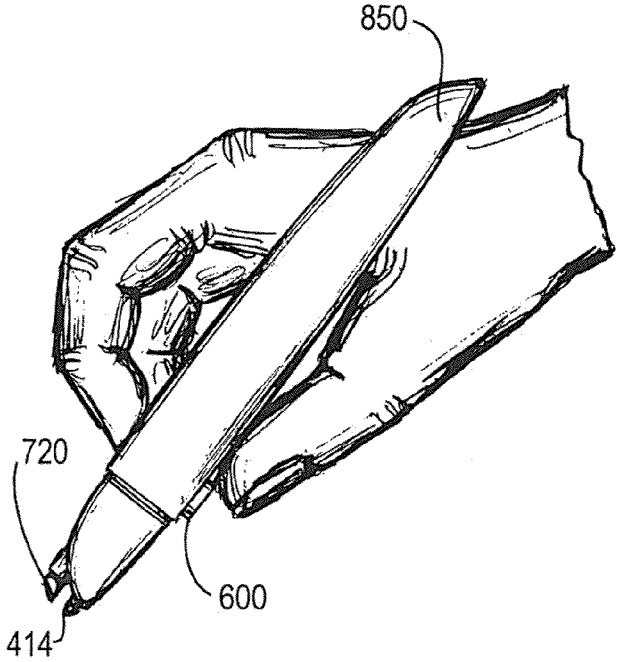
FIG. 7C is a side view of the highlighter-pen combination of the present invention, being used as a pen, with the highlighter still extended.
Figure 7D:
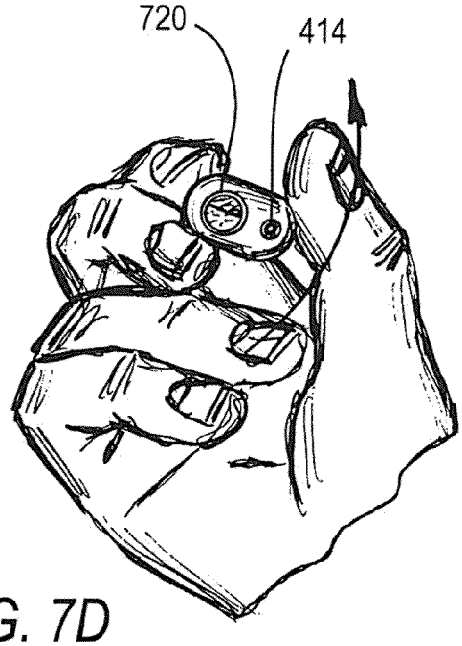
FIG. 7D is a front view of the highlighter-pen combination of the present invention, being rotated to bring the highlighter tip to the bottom position.

In a second embodiment, illustrated in FIGS. 7A-7D, the highlighter pen is operated without the use of button 600. In this embodiment, the highlighter pen remains in highlighter extended position at all times. FIG. 7A illustrates the user writing with highlighter tip 720, as with the previous embodiment. FIG. 7B then illustrates the user rotating the pen to bring the pen tip 414 below highlighter tip 720. The user can now write using pen tip 414 while highlighter tip 720 is extended, as shown in FIG. 7C. Lastly, FIG. 7D illustrates the user rotating the pen back to the position of FIG. 7A.

In designing a highlighter and pen combination that provides a comfortable transition from pen to highlighter or highlighter to pen, many difficulties were encountered and overcome.

A first design included two identical length members, one having a highlighter and the second having a pen. The two members were connected with a pivot joint. The joint allowed the pen and the highlighter to be fully collapsed, partially opened or fully opened. Both the pen and the highlighter could be operated in any of the positions. This design was abandoned because transitioning from one instrument to the other proved uncomfortable for users and lacked the ergonomic advantages of the preferred embodiment.

A second design comprised a main body having a pen, with a separate highlighter stored inside the body and attached to the body by a pivot joint. The highlighter faced the rear of the pen when stored and included its own grip. The user could flip the highlighter out when transitioning from pen to highlighter. A third design also included a highlighter with its own grip stored inside the pen and attached by a pivot joint except the highlighter faced forward while in storage. Both of these designs proved uncomfortable for users and lacked the ergonomic advantages of the preferred embodiment.

A fourth design built upon the pivot concept of the first three. The third design stored the highlighter inside the pen, but the highlighter was much smaller and lacked a separate grip. The pen included a button mechanism that could be toggled to pivot the highlighter into a usable position and pivot the highlighter back inside the pen for storage. During both highlighter operation and pen operation, the same grip was used. Again, this design proved uncomfortable for users. Additionally, the design failed to provide for the inclusion of a large highlighter fluid reservoir.

A fifth design incorporated the single grip from the fourth design but replaced the pivot with a button mechanism. The fifth design stacked a pen on top of a highlighter and provided a top button for extending and retracting the highlighter. The button operated using a single spring a locking notches within the plastic frame. While the device had ergonomic merit, the button mechanism did not operate consistently.

Although the invention has been described in terms of particular embodiments, the embodiments are merely illustrative of an application of the principles of the invention. Numerous modifications may be made and other arrangements may be devised without departing from the spirit and scope of the invention.

We claim:

1. A dual highlighter and pen apparatus comprising:

an elongated body having a height which is greater than its width, the elongated body having a distal end and a proximal end;

an anchor positioned inside the elongated body;

a pen, having a distal end and a proximal end, the pen stabilized by the anchor and aligned along the lengthwise direction of the elongated body;

a highlighter, having a distal end and a proximal end, the highlighter fixedly connected to the anchor and aligned along the lengthwise direction of the elongated body, wherein the highlighter is displaced from and is parallel to the pen;

a button positioned on the exterior of the elongated body and connected to the anchor, the button adapted to move the anchor and the highlighter along the lengthwise direction of the elongated body; and a flat spring connecting the button to the anchor;

wherein the proximal end of the highlighter is extendable outward from the proximal end of the elongated body.

2. The dual highlighter and pen apparatus of claim 1, wherein the pen is fixed to the elongated body.

3. The dual highlighter and pen apparatus of claim 1, wherein:

the anchor includes a hole and the pen is positioned through the hole.

4. The dual highlighter and pen apparatus of claim 1, wherein:

the flat spring has legs which are engaged within the anchor upon a force being applied to the spring.

5. A dual highlighter and pen apparatus comprising:

an elongated body having a height which is greater than its width, the elongated body having a distal end and a proximal end;

an anchor positioned inside the elongated body;

a pen, having a distal end and a proximal end, the pen stabilized by the anchor and aligned along the lengthwise direction of the elongated body;

a highlighter, having a distal end and a proximal end, the highlighter fixedly connected to the anchor and aligned along the lengthwise direction of the elongated body, wherein the highlighter is displaced from and is parallel to the pen;

a button positioned on the exterior of the elongated body and connected to the anchor, the button adapted to move the anchor and the highlighter along the lengthwise direction of the elongated body; and a coil spring positioned between the highlighter and the elongated body, wherein the coil spring biases the highlighter rearward;

wherein the proximal end of the highlighter is extendable outward from the proximal end of the elongated body.

6. A dual highlighter and pen apparatus comprising:

an elongated body having a distal end and a proximal end;

an anchor positioned inside the elongated body, the anchor including a pen support and a rear connection channel;

a pen having a writing point, the pen stabilized by the pen support and aligned along the lengthwise direction of the elongated body;

a highlighter having a highlighting point, the highlighter fixedly connected to the anchor and aligned along the lengthwise direction of the elongated body, wherein the highlighter is displaced from and parallel to the pen; and a button positioned on the exterior of the elongated body and connected to the anchor, the button controlling a position of the anchor and the highlighter along the lengthwise direction of the elongated body;

a flat spring connecting the button to the anchor; and a coil spring positioned between the highlighter and the elongated body;

wherein the highlighting point of the highlighter is extendable outward from the proximal end of the elongated body;

wherein the highlighter further includes a wick and the wick is positioned within the coil spring; and wherein the flat spring is positioned in the rear connection channel.

* * * * *